United States Patent [19]

Manke

[11] Patent Number: 4,573,535

[45] Date of Patent: Mar. 4, 1986

[54] SLEEVE-TYPE LOW PRESSURE RESPONSIVE APR TESTER VALVE

[75] Inventor: Kevin R. Manke, Marlow, Okla.

[73] Assignee: Halliburton Company, Duncan, Okla.

[21] Appl. No.: 667,651

[22] Filed: Nov. 2, 1984

[51] Int. Cl.[4] ..... E21B 34/10

[52] U.S. Cl. ..... 166/321; 166/142; 166/332

[58] Field of Search ..... 166/321, 324, 332, 334, 166/250, 188, 133, 142, 152; 251/62, 63

[56] References Cited

U.S. PATENT DOCUMENTS

| | | | |
|---|---|---|---|
| Re. 29,562 | 3/1978 | Wray et al. | 166/162 X |
| Re. 29,638 | 5/1978 | Nutter | 73/151 |
| 2,604,169 | 7/1952 | Miller | 166/188 |
| 3,662,824 | 5/1972 | Page, Jr. | 166/72 |
| 3,662,825 | 5/1972 | Nutter | 166/152 |
| 3,662,826 | 5/1972 | Young et al. | 166/152 |
| 3,796,261 | 3/1974 | Nutter | 166/237 |
| 3,823,773 | 7/1974 | Nutter | 166/250 X |
| 3,850,250 | 11/1974 | Holden et al. | 166/315 |
| 3,858,649 | 1/1975 | Wray et al. | 166/162 |
| 3,860,069 | 1/1975 | Wray et al. | 166/264 |
| 3,891,033 | 6/1975 | Scott | 166/133 |
| 3,900,068 | 8/1975 | Scott | 166/152 |
| 3,901,314 | 8/1975 | Nutter | 166/152 |
| 3,964,305 | 6/1976 | Wray et al. | 73/151 |
| 3,970,147 | 7/1976 | Jessup et al. | 166/250 |
| 3,986,554 | 10/1976 | Nutter | 166/151 X |
| 4,015,662 | 4/1977 | Cochran | 166/104 |
| 4,050,512 | 9/1977 | Giebeler | 166/128 |
| 4,113,012 | 9/1978 | Evans et al. | 166/264 |
| 4,324,293 | 4/1982 | Hushbeck | 166/317 |
| 4,328,866 | 5/1982 | Zimmerman | 166/317 |
| 4,422,506 | 12/1983 | Beck | 166/324 |
| 4,429,748 | 2/1984 | Beck | 166/324 |

*Primary Examiner*—James A. Leppink
*Assistant Examiner*—Hoang C. Dang
*Attorney, Agent, or Firm*—James R. Duzan; Thomas R. Weaver; E. Harrison Gilbert, III

[57] ABSTRACT

An annulus pressure responsive tester valve which includes a pressure-assisted isolation valve including a pressure differential metering cartridge utilizes a sleeve-type valve section having a ported sleeve mandrel and a ported outer valve sleeve member and also having a choke associated therewith for controlling the flow of fluids through the sleeve-type valve.

18 Claims, 6 Drawing Figures

SLEEVE-TYPE LOW PRESSURE RESPONSIVE APR TESTER VALVE

BACKGROUND OF THE INVENTION

This invention relates generally to sleeve-type low pressure responsive APR tester valves and more particularly, but not by way of limitation, to a sleeve-type low pressure responsive APR tester valve capable of controlling its operation regardless of temperature effects brought about by relatively cold fluids pumped through the tester valve.

The present invention is particularly useful in testing of offshore wells where it is desirable to conduct testing operations and well stimulation operations utilizing the testing string tools with a minimum of testing string manipulation, and preferably with the blowout preventors closed during most operations.

It is known in the art that tester valves and sampler valves for use in oil and gas wells may be operated by applying pressure increases to the fluid in the annulus between the wellbore and the testing string disposed in the well. It is also known that such valves can include either ball-type or sleeve-type valves. In the ball-type valve a spherical member is rotatable between closed and opened positions, whereas in the sleeve-type valve two telescopic members are relatively slidable between closed and opened positions.

It is also known that low pressure responsive APR tester valves adapted for metering flows of the fluid whereby proper operation is achieved regardless of temperature effects are also known. Such a low pressure responsive APR tester valve, which utilizes a ball-type valve, is disclosed in U.S. Pat. No. 4,429,748 to Beck.

It has become desirable to have a tester valve of the general type described in U.S. Pat. No. 4,429,748, but with a sleeve-type valve with a simpler construction and operation. In such a new type of tester valve, it is also desirable to have the capability of using a selectable one of a plurality of chokes for properly controlling the flow through the valve to reduce washing effects which abrade or wear the surfaces of the valve and valve case. This choke may also aid in obtaining reservoir data for quantitative interpretation. A further significant need is to provide a sleeve-type tester valve that can be pressure tested to pressure levels in excess of those which can be performed with a ball-type tester valve. Furthermore, to permit the economical use of both ball and sleeve types where needed, it would be preferable to construct such a sleeve-type valve so that it can be readily connectible to the prior art low pressure responsive APR tester valves directly in place of the presently known ball valve section thereof.

SUMMARY OF THE INVENTION

The present invention provides such a novel and improved sleeve-type low pressure responsive APR tester valve which meets the above-noted needs. The present invention has a sleeve valve section of simple construction and operation. The present invention includes a choke which can be any one of a plurality of selectable chokes so that washing effects on the valve and valve casing are reduced. The choke can also aid in obtaining reservoir data for quantitative interpretation. The construction of the present invention permits relatively high pressure tests in excess of those which could heretofore be conducted with ball-type tester valves. The specific embodiment of the present invention is also constructed in a sectional form so that it can directly replace the ball valve section of the prior art low pressure responsive APR tester valve disclosed in U.S. Pat. No. 4,429,748.

Broadly, the tester valve of the present invention is constructed for use with a housing having a mandrel slidably disposed therein. The mandrel is operable to open and close a valve section of the present invention. In the preferred embodiment, this movement is brought about my means, responsive to changes in the pressure of the fluid in the annulus between the tester valve and the wellbore, for moving the mandrel to a valve open position when the pressure of the fluid in the annulus changes from a hydrostatic pressure to a greater than hydrostatic pressure and for moving the mandrel to a valve closed position when the pressure of the fluid in the annulus changes from the greater than hydrostatic pressure to a sufficient lesser pressure, such as the hydrostatic pressure.

The inventive valve section of the present invention includes a valve mandrel having a main body threadedly connectible to the testing string which is run into the wellbore. The valve mandrel also has a neck extending from the main body. The neck has a transverse opening defined therethrough in communication with a cavity defined in the main body and in the neck for providing a flow path communicating with the testing string. The valve section further includes a valve sleeve having the neck of the valve mandrel slidably received therein. The valve sleeve is slidable between a valve closed position and a valve open position relative to the neck. The valve sleeve has an opening defined therein so that when the valve sleeve is at the valve closed position the opening of the valve sleeve is spaced from the transverse opening of the valve mandrel. Disposed in this space is a suitable seal means which is also included in the valve section of the present invention. The valve section further includes choke means for controlling the flow of fluid from the remainder of the tester valve into the valve sleeve.

Therefore, from the foregoing, it is a general object of the present invention to provide a novel and improved sleeve-type low pressure responsive APR tester valve. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

It is to be initially noted that some of the preferred embodiment tester valve of the present invention is similar to the tester valve described in U.S. Pat. No. 4,429,748, issued to the assignee of the present invention on Feb. 7, 1984. The principal difference between that invention and the present invention is the construction of the present sleeve valve section which replaces the ball-type valve section 30 described in U.S. Pat. No. 4,429,748. This patent is incorporated herein by reference to provide disclosure and to support the claims herein with regard to those portions of the present invention which are similar to the invention described in the aforementioned patent.

Figure 1A:
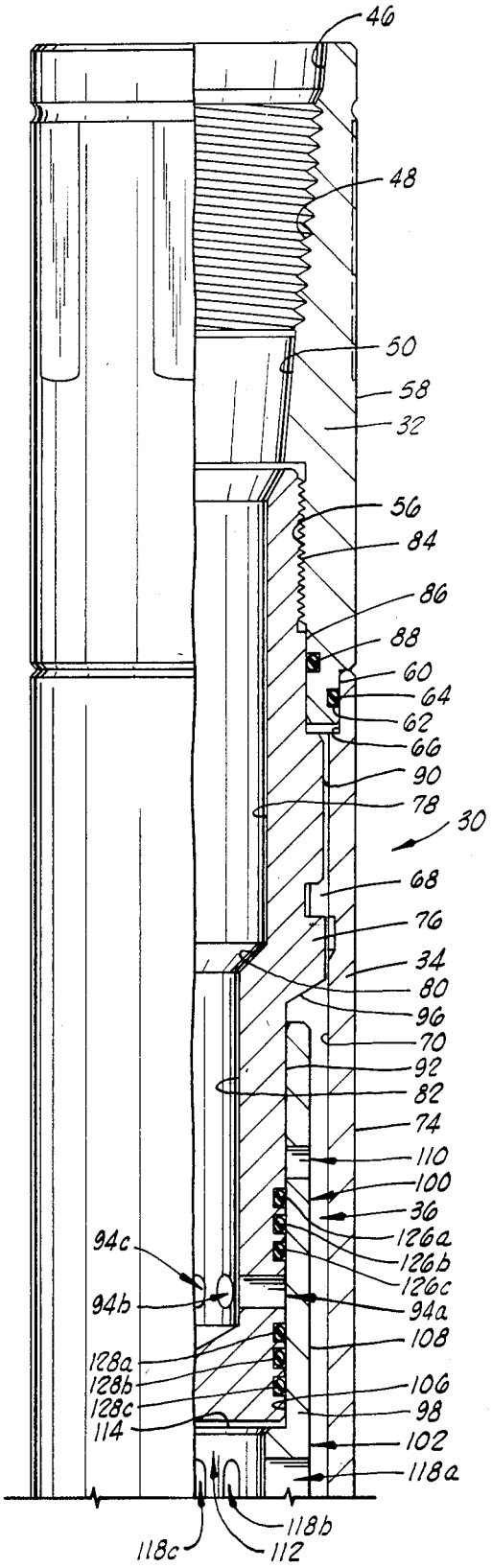
FIGS. 1A–1F form a partial sectional view of the sleeve-type low pressure responsive APR tester valve constructed in accordance with the preferred embodiment of the present invention.
Figure 1B:
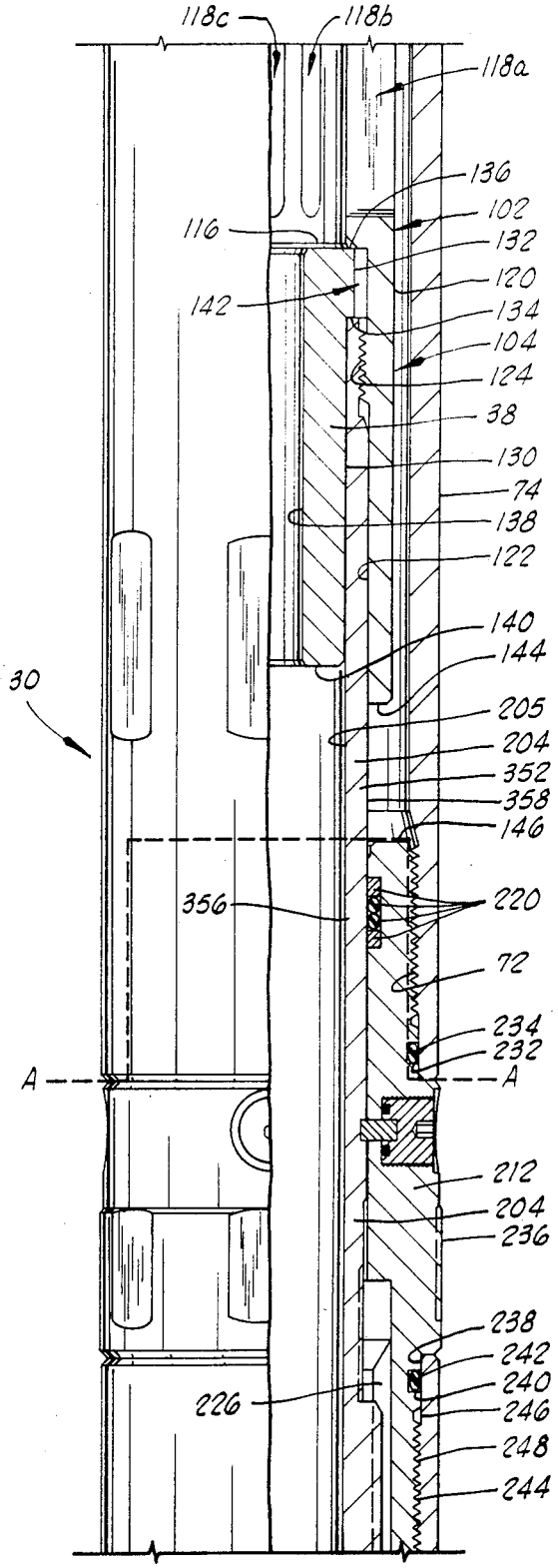
Figure 1C:
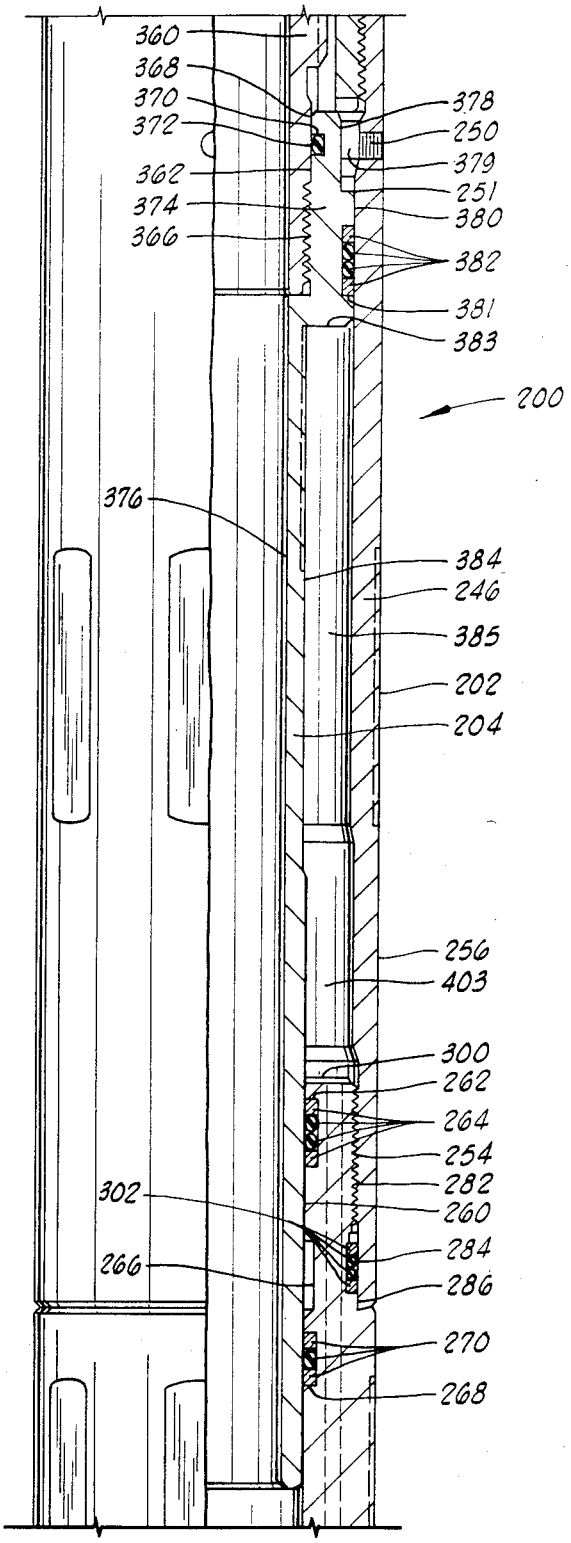
Figure 1D:
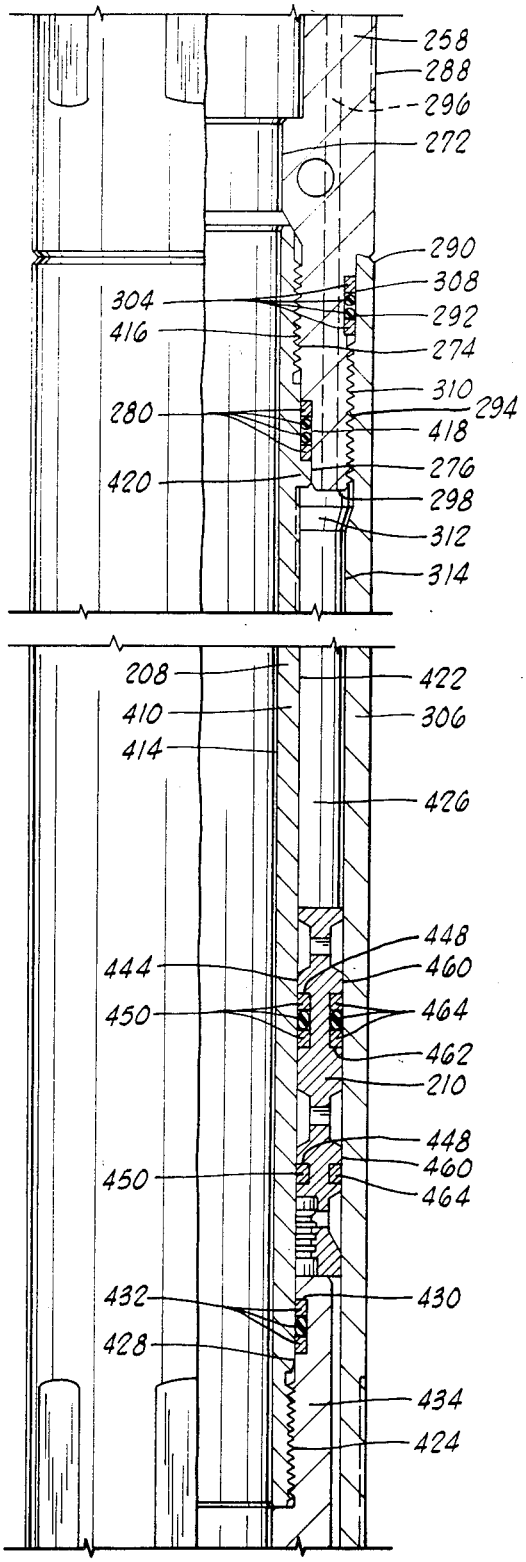
Figure 1E:
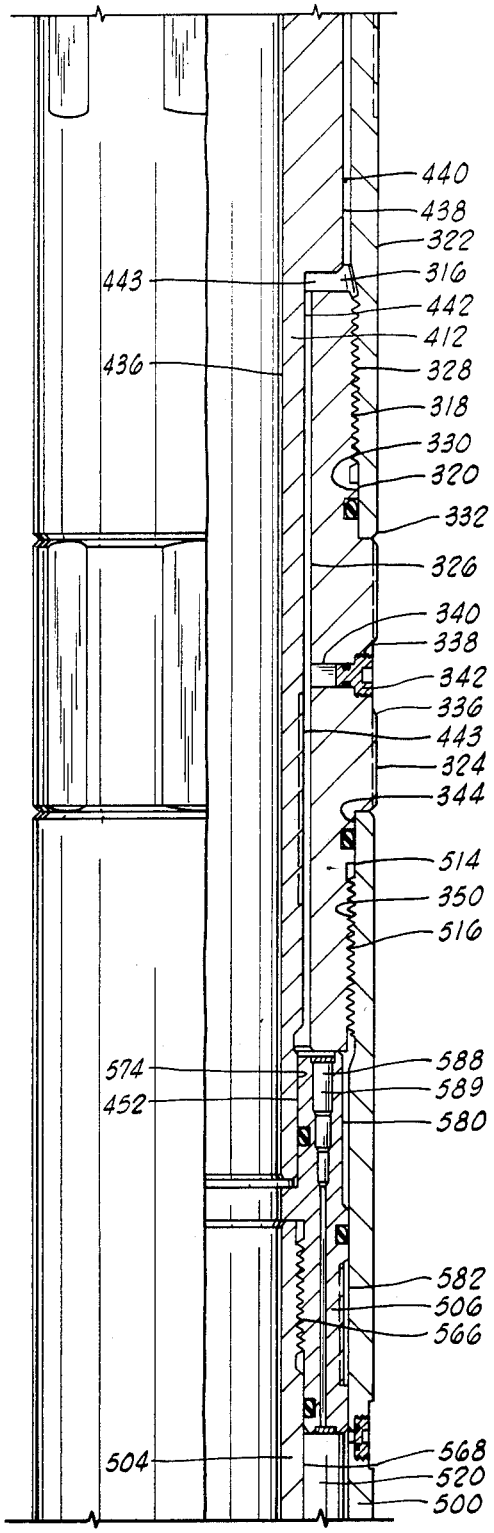
Figure 1F:
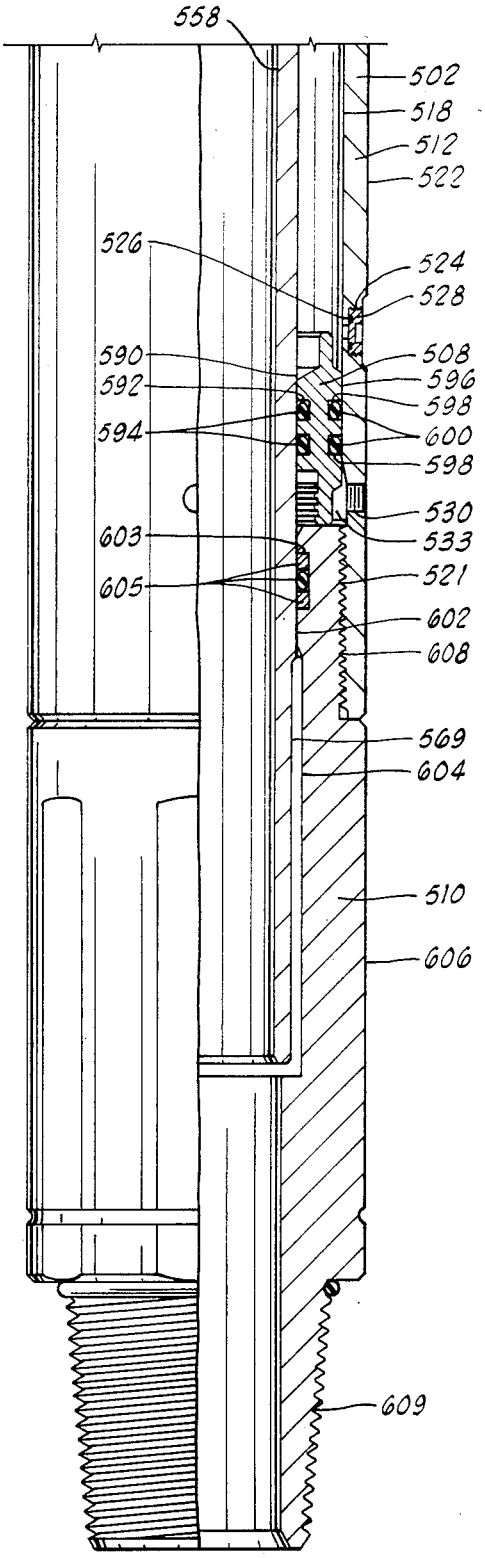

Generally, the present disclosure will be directed to a new sleeve valve section 30 shown in FIGS. 1A-1B above line A—A, which sleeve valve section is different from the valve section 30 of U.S. Pat. No. 4,429,748. The description of the remaining part of the tester valve extending below line A—A will be made by incorporating herein by reference the aforementioned patent; however, summaries or brief references to portions of the remaining part of the tester valve, and references to any substantial differences in the portion below line A—A from what is described in U.S. Pat. No. 4,429,748, will be made herein. In the drawings hereof, the reference numerals for those portions incorporated by reference are the same as those of U.S. Pat. No. 4,429,748.

The preferred embodiment of the present invention provides a tester valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through the valve and also to allow the introduction of fluids into that portion of the wellbore below the packer through the valve in the testing string. In this regard, the present invention is suitable for the same usages as the tester valve described in U.S. Pat. No. 4,429,748 incorporated herein by reference. This type of valve is responsive to changes in the pressure of the fluid in the annulus between the wellbore and the well testing string in that portion of the wellbore above the packer when the packer sealingly engages the wellbore. This tester valve constructed in accordance with the preferred embodiment of the present invention is illustrated in FIGS. 1A-1F.

The tester valve of the present invention comprises a housing and internal components which can be divided into three structural and operational sections. These sections include a sleeve valve section 30, a power section 200, and an isolation valve section 500.

The sleeve valve section 30 includes an adapter 32, a valve case 34, a sleeve valve 36 and a choke 38.

The adapter 32 is similar to the one described in U.S. Pat. No. 4,429,748. Particularly, the adapter 32 comprises a cylindrical elongated annular member having a first bore defined by a surface 46, having a first threaded bore defined by a surface 48 which is of smaller diameter than the bore 46, having a second bore defined by a surface 50 which is of smaller diameter than the bore 48, having a second threaded bore defined by a surface 56, having a first cylindrical exterior portion with a surface 58 and having a second cylindrical exterior portion with a surface 60 which is of smaller diameter than the portion 58 and which contains an annular seal cavity 62 having an elastomeric seal means 64 therein. The adapter 32 secures the tester valve to the testing string via the threaded bore 48. The bores or surfaces 46, 48, 50 and 56 define an internal opening communicating with the interior of the remainder of the testing string connected to the adapter 32.

The valve casing 34 of the present invention is also similar to the valve casing 34 described in U.S. Pat. No. 4,429,748 so that the valve casing 34 of the present invention can be directly connected to the invention described therein in place of the therein disclosed ball-type valve section. In particular, the valve case 34 comprises a cylindrical elongated annular member having a first bore defined by a surface 66, having a plurality of internal lug means 68 circumferentially spaced about the interior of the valve case 34 near one end thereof, having a second bore defined by a surface 70 which is of a smaller diameter than that of the bore 66, having a threaded bore defined by a surface 72 and having a cylindrical exterior surface 74 thereon. The bore 66 sealingly engages the second cylindrical exterior portion 60 of the adapter 32 when the case 34 is assembled therewith. The bore 70 provides a chamber in which the sleeve valve 36 of the present invention is disclosed. The lugs 68 are disposed at the upper end (as viewed in FIG. 1A) of this chamber, or hollow interior, of the elongated body of the valve case 34.

The sleeve valve 36 includes a ported plug member or valve mandrel 76. In the preferred embodiment, the valve mandrel 76 is a unitary body with an open-ended main body having a closed-ended neck extending therefrom. The open end of the main body communicates a longitudinal cavity, defined by inner surfaces 70, 80, 82, with the opening defined through the adapter 32 to which the valve mandrel 76 is connected at a threaded surface 84. The inner surface 78 is cylindrically shaped and has a diameter which is greater than the diameter of the cylindrical surface 82. The inner surface 78 is defined longitudinally through the main body portion of the valve mandrel 76, and the surface 82 extends longitudinally through the neck portion thereof. The surface 80 is tapered and joins the surface 78 with the surface 82.

The threaded surface 84 extends longitudinally to an unthreaded surface 86 which sealingly adjoins an interior surface of the adapter 32, which interior surface has an elastomeric sealing means 88 disposed therein. Extending from the surface 86 are a plurality of lugs 90 which extend radially outwardly from the valve mandrel 76 for engagement with the lugs 68 of the valve case 34.

The valve mandrel 76 also has a ported outer surface 92 having a diameter which is less than the diameters of either of the surfaces 84, 86 or of the lugs 90. The diameter of the surface 92 is also less than the diameter of the interior surface 70 of the valve case 34 so that an annulus is defined therebetween. The ported outer surface 92 has a transverse port or opening extending therefrom inwardly to the inner surface 82 so that the longitudinal cavity defined in the valve mandrel 76 communicates with the outer surface 92. More particularly, the preferred embodiment of the outer surface 92 and the valve mandrel 76 includes eight radial ports, three of which are identified by the reference numerals 94*a*, 94*b*, 94*c*. Connection the surfaces of greater diameter with the smaller diameter surface 92 is a tapered outer surface 96 which can be said to be disposed at the top of the annulus defined between the outer surface 92 and the interior surface 70 of the valve case 34.

The sleeve valve 36 also includes a valve sleeve member 98 defined by a unitary cylindrical body having a ported end portion 100, a central web portion 102, and an interface end portion 104.

The end portion 100 has an annular shape defined by an interior surface 106 and an exterior surface 108. The interior surface 106 has a diameter substantially equal to the diameter of the outer surface 92 of the neck of the valve mandrel 76. There is a slight tolerance differential so that the surface 106 and the surface 92 are relatively slidable. The surface 108 has a diameter which is less than the diameter of the surface 70 of the valve case 34 whereby the end portion 100 lies within the annulus defined between the surface 92 of the valve mandrel 76 and the surface 70 of the valve case 34, but whereby there is still an annular space defined between the surface 108 and the surface 70. Extending between the surfaces 106, 108 through the annular ported end portion 100 and intermediate the web portion 102 and the terminating edge of the end portion 100 is at least one radially extending opening 110. In the preferred embodiment there are eight such openings or ports 110. The openings 110 are movable, along with the end portion 100, between the valve closed position shown in FIG. 1A and a valve opened position wherein the openings 110 are aligned with the ports 94 so that fluid flow between the surface 108/surface 70 annulus and the cavity within the valve mandrel 76 can be effected. As illustrated in FIG. 1A, the neck of the valve mandrel 76 is concentrically received within the longitudinal cavity defined within the end portion 100 by the interior surface 106.

The central web portion 102 of the preferred embodiment is a cylindrical member integrally disposed between the end portions 100, 104. The central web portion 102 has an interior cavity 112 defined therein. The cavity 112 has an open end defined through a transverse wall 114 adjacent which the neck portion of the valve mandrel 76 is disposed when the valve is in its closed position. Another opening into the cavity 112 is defined through an opposite transverse wall 116. The cavity is communicated with the annulus defined between the sleeve valve 36 and the valve case 34 by one or more transverse openings, which openings are illustrated in FIGS. 1A, 1B as including a plurality of longitudinally shaped slots, three of which are identified by the reference numerals 118*a*, 118*b*, 118*c*. The slots 118 are made relatively large so that the flow velocity of a fluid flowing through the web portion 102 is reduced to likewise reduce the abrasive washing effects created by the fluid flowing at right angles between the slots 118 and the ports 94 through the annulus between the sleeve valve 36 and the valve case 34. The exterior surface of the central web portion 102 is coextensive with the surface 108 of the end portion 100.

The interface end portion 104 extends longitudinally from the web portion 102 opposite the ported end portion 100. The end portion 104 has an exterior surface 120 which is coextensive with the exterior surfaces of the portions 100, 102. The end portion 104 is annularly shaped as defined by the exterior surface 120 and an interior surface 122. The interior surface 122 has a portion 124 which is threaded. The threaded portion 124 is disposed intermediate the free end of the end portion 104 and the end thereof integrally formed with the web portion 102. The threaded portion 124 is constructed so that it can engage the threaded end of the power mandrel 204 of the invention disclosed in U.S. Pat. No. 4,429,748 so that the present invention can be used to directly replace the ball-type valve section described therein.

The sleeve valve 36 also includes seal means. A first part of the seal means is shown in FIG. 1A as including three elastomeric sealing elements 126*a*, 126*b*, 126*c*, such as O-rings or other suitable sealing members. These three sealing elements are disposed in circumferential grooves defined in parallel spaced longitudinal relation in the surface 92 of the neck portion of the valve mandrel 76. The grooves and the sealing members 126*a*, 126*b*, 126*c* are disposed on the side of the flow ports 94 closer to the main body of the valve mandrel 76 so that they provide a fluid-tight seal between the surfaces 92, 106 in between the ports 94 and the openings 100 when the sleeve valve 36 is in its closed position.

The seal means includes a second portion shown in FIG. 1 as including three sealing elements 128*a*, 128*b*, 128*c*, such as O-rings or other suitable sealing members, which sealing elements are disposed in corresponding grooves defined in the surface 92 on the opposite side of the ports 94 from the sealing elements 126*a*, 126*b*, 126*c*. The sealing elements 128*a*, 128*b*, 128*c* provide a fluid-tight seal between the surfaces 92, 106 so that fluid and pressure are not communicated along these surfaces from the opening in the wall 114 to the ports 94.

The choke 38 of the valve section 30 is shown in FIG. 1B as including a unitary cylindrical main body portion having an outward cylindrical surface 130. At one end of the main body there is defined a flanged end portion having an outward surface 132 with a greater diameter than the diameter of the surface 130. The surfaces 130, 132 have a radial annular surface 134 extending therebetween. The surface 132 terminates opposite the surface 134 at an end surface 136. Extending longitudinally through the choke 38 is an inward surface 136 defining a longitudinal cavity extending between the end surface 138 and another end surface 140. The choke 38 is disposed concentrically within the end portion 104 of the valve sleeve member 98 so that the end surface 136 abuts the end wall 116 of the web portion 102 and so that the radial annular surface 134 abuts the power mandrel 204 forming a part of the power section 200 as subsequently described. This disposition of the choke 38 holds the longitudinal cavity defined therein in communication with the longitudinal cavity 112 defined in the web portion 102 of the valve sleeve member 98. The diameter of the surface 132 is less than the diameter of the surface 122 of the end portion 104 of the valve sleeve member 98 so that an annular space 142 is defined therebetween. Although the illustrated disposition of the choke 38 shows metal-to-metal contact between the end wall 116 and the end surface 136 and between the radial annular surface 134 and the power mandrel 204, these areas of contact can include suitable elastomeric sealing members.

In the preferred embodiment, the choke 38 is of a suitable construction having an unthreaded surface for being slidingly received within the interior of the power mandrel 204; however, it is contemplated that other types of suitable chokes can be used. For example, the present invention can be adapted to carry a standard 6-inch beam choke. The type of choke to be selected will depend upon the desired flow through the valve that is desired and the construction of the power mandrel 204. The choke 38 is used to reduce the aforementioned washing which occurs in the flow path between the cavity 112 of the web portion 102 and the flow ports 94. By using the choke 38, the washing tends to occur therein rather than in the remainder of the flow path whereby the easily replaceable choke 38 is subjected to the abrasive wearing forces rather than the elements of the sleeve valve 36. The choke can also be used as an aid in obtaining reservoir data for quantitative interpretation in a manner as known to the art.

The power section 200 of the present invention is substantially the same as the power section 200 described in U.S. Pat. No. 4,429,748; therefore, the power section 200 will not be described in detail in view of the description thereof incorporated herein by reference. However, it is noted that the power section 200 of the present invention generally includes a power case 202, the aforementioned power mandrel 204, a fluid mandrel 208 and a gas-fluid balancing seal 210. In the present invention, the resilient ring assembly 206 described in U.S. Pat. No. 4,429,748 is not included. Also deleted from this section of the present invention are the lug 255 and the cap 800 described at column 7, line 16 and column 8, line 60 to column 9, line 2, respectively, of U.S. Pat. No. 4,427,748.

Another difference is that the power mandrel 204 of the present invention does not include the radial openings shown therein in the middle of FIG. 2*b* of U.S. Pat. No. 4,429,748. These openings have been removed in the present invention to further reduce washing effects on the operating elements of the present invention.

The power mandrel 204 of the present invention has an interior surface 205 having a diameter substantially equal to the diameter of the surface 130 of the choke 38 so that the choke 38 can be concentrically received within the elongated passageway defined through the power mandrel 204 by the surface 205.

The isolation valve section 500 of the present invention is similar to the corresponding valve section 500 described in U.S. Pat. No. 4,429,748 which is incorporated herein by reference. Generally, the isolation valve section 500 comprises an isolation case 502, an isolation valve mandrel 504, a metering cartridge 506, a fluid balancing piston 508, and an adapter 510. The isolation valve section 500 provides a means for moving the power mandrel 204 to achieve the valve open position when the pressure of the fluid in the annulus between the tester valve and the wellbore changes from a hydrostatic pressure to a greater than hydrostatic pressure and for moving the power mandrel 204 to achieve the valve closed position when the pressure of the fluid in the annulus changes from such greater pressure to a lesser pressure, such as back to the hydrostatic pressure.

Generally, the present invention operates in a manner similar to the invention described in U.S. Pat. No. 4,429,748 except that a sleeve-type valve rather than a ball-type valve is used. Furthermore, in the present invention the aforementioned resilient ring assembly 206 is not needed to achieve the required opening and closing action.

More particularly, as the isolation valve section 500 and the power section 200 respond to the pressure changes in the annulus between the tester valve and the wellbore in the manner described in U.S. Pat. No. 4,429,748, the power mandrel 204 is moved in either a downward or upward direction as viewed in the drawings. If the power mandrel 204 is moved downwardly, it pulls the valve sleeve member 98 until the openings 110 are in fluid communication with the flow ports 94. The extent of this downward travel is limited by a radial end surface 144 at the lower terminating edge of the valve sleeve member 98 engaging a radial end surface 146 at the top of the remainder of the housing of the tester valve of the present invention.

With the openings 110 in fluid communication with the ports 94, fluid can flow in either direction through the adapter 32, the valve case 34, the sleeve valve 36 and the choke 38. Use of the choke 38 and the enlarged slots 118 aids in reducing the velocity, and thus the washing effects, of the flowing fluid.

When the power mandrel 204 moves upwardly until the neck portion of the valve mandrel 76 is received in the valve sleeve member 98 as illustrated in FIG. 1A whereby the openings 110 are fluid-tightly sealed from the ports 94, the tester valve is then placed in its closed position wherein the continuous flow of fluid therethrough is terminated.

From the foregoing, it is apparent that the present invention provides a low pressure responsive APR tester valve which eliminates the ball valve section therefrom and substitutes therefor a sleeve valve. The present invention also permits the inclusion of a downhole choke for controlling the flow of fluids. The construction of these elements is designed so that it can be connected to the prior type of tester valve in place of the previously used ball valve section. Additionally, the sleeve-type low pressure responsive APR tester valve of the present invention can be used for conducting pressure tests greatly in excess of those which can be conducted with the ball-type tester valves. For example, the preferred embodiment of the present invention has been found to be capable of holding up to 10,000 pounds per square inch of pressure from the top side, whereas the corresponding ball-type tester valve is capable of holding approximately 5,000 pounds per square inch of pressure.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through said valve in the testing string as well as the introduction of fluids into that portion of the wellbore below the packer through said valve in the testing string, said valve being responsive to changes in the pressure of the fluid in the annulus between the wellbore and the well testing string in that portion of the wellbore above the packer when the packer sealingly engages the wellbore, said valve comprising:

a housing;

mandrel means, slidably disposed within said housing, for providing a fluid conduit within said housing;

means, responsive to changes in the pressure of the fluid in the annulus, for moving said mandrel means to a valve open position when the pressure of the fluid in the annulus changes from a hydrostatic pressure to a greater than hydrostatic pressure and for moving said mandrel means to a valve closed position when the pressure of the fluid in the annulus changes from the greater than hydrostatic pressure to a lesser pressure; and sleeve valve means, connected to said housing, for providing a controllable fluid passageway in communication with said fluid conduit provided by said mandrel means, said sleeve valve means including:

an outer cylindrical sleeve member having a central web portion from which extend a ported end portion, having a first radial opening defined therethrough intermediate said web portion and a terminating edge of said ported end portion, and an interface end portion, having an internally threaded surface disposed intermediate said web portion and a terminating edge of said interface end portion, said internally threaded surface engaging with a complemental threaded surface of said mandrel means so that at least a portion of said interface end portion is concentrically disposed about a portion of said mandrel means, and said web portion having a cavity defined therein in fluid communication with said fluid conduit provided by said mandrel means;

ported plug means for providing a fluid channel communicating with the outside of said housing, said ported plug means including a body having a closed end disposed adjacent said web portion concentrically within said ported end portion of said outer cylindrical sleeve member when said mandrel means is at said valve closed position, said body also having a second radial port defined therein for communicating with said first radial opening of said sleeve member when said mandrel means is at said valve open position;

first seal means for providing a seal between said first and second radial openings when said mandrel means is at said valve closed position; and second seal means for providing a seal between said closed end of said ported plug means body and said ported end portion of said sleeve member.

2. The valve of claim 1, further comprising selectable choke means for providing a selectable constricted flow area from said mandrel means to said cavity of said web portion.

3. The valve of claim 2, wherein:

said interface end portion of said outer sleeve member further has an interior surface extending between said internally threaded surface of said interface end portion and a transverse end surface of said web portion;

said mandrel means terminates at one end adjacent said internally threaded surface of said interface end portion in spaced relation to said transverse end surface of said web portion; and said choke means includes a cylindrical member having a main body disposed in said fluid conduit provided by said mandrel means and having a flanged end extending radially outwardly into the space between said transverse end surface of said web portion and said one end of said mandrel means and towards said interior surface of said interface end portion.

4. The valve of claim 1, wherein:

said housing includes:

a valve casing having a hollow interior in which said sleeve valve means is disposed, said valve casing having a lug extending radially inwardly into said hollow interior; and an upper adapter member associated with one end of said valve casing;

said sleeve member has an interior surface with a first diameter defining a cavity;

said body of said ported plug includes:

a threaded cylindrical outer surface having a second diameter, said threaded surface threadedly connected to said upper adapter member;

a radially outwardly extending lug, extending longitudinally from said threaded cylindrical outer surface radially to a third diameter greater than said second diameter, for engaging said inwardly extending lug of said valve casing;

a cylindrical ported surface, having a fourth diameter less than said second diameter but substantially equal to said first diameter, slidably disposed in said cavity defined by said interior surface of said sleeve member, said ported surface having said first and second seal means disposed thereon; and a tapered outer surface connecting said outwardly extending lug with said ported surface.

5. The valve of claim 4, further comprising selectable choke means for providing a selectable constricted flow area from said mandrel means to said cavity of said web portion.

6. The valve of claim 5, wherein:

said interface end portion of said outer sleeve member further has an interior surface extending between said internally threaded surface of said interface end portion and a transverse end surface of said web portion;

said mandrel means terminates at one end adjacent said internally threaded surface of said interface end portion in spaced relation to said transverse end surface of said web portion; and said choke means includes a cylindrical member having a main body disposed in said fluid conduit provided by said mandrel means and having a flanged end extending radially outwardly into the space between said transverse end surface of said web portion and said one end of said mandrel means and towards said interior surface of said interface end portion.

7. A valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through said valve in the testing string as well as the introduction of fluids into that portion of the wellbore below the packer through said valve in the testing string, said valve being responsive to changes in the pressure of the fluid in the annulus between the wellbore and the well testing string in that portion of the wellbore above the packer when the packer sealingly engages the wellbore, said valve comprising:

sleeve valve section means, including:

adapter means for securing said valve to the testing string;

a valve mandrel having a main body threadedly connected to said adapter means and having a neck extending from said main body, said neck having a transverse opening defined therethrough in communication with a cavity defined in said main body and said neck for communicating with said adapter means;

seal means disposed near said transverse opening; and a valve sleeve having said neck of said valve mandrel slidably received therein, said valve sleeve being slidable between a valve closed position and a valve open position relative to said neck, said valve sleeve having an opening defined therein so that when said valve sleeve is at said valve closed position at least a portion of said seal means is disposed between said opening of said valve sleeve and said transverse opening of said valve mandrel;

power section means connected to said sleeve valve section means and responsive to changes in the pressure of the fluid in the annulus, said power section means including means for moving said valve sleeve between said valve open and valve closed positions; and isolation valve means for being continuously responsive substantially without interruption during such time as said valve is located in said wellbore to changes in the pressure of the fluid in the annulus so that said power section means is maintained at a level of force sufficient to move said valve sleeve to said closed position regardless of the hydrostatic pressure and temperature of the fluid in the annulus and the pressure and temperature of the fluid in said valve in the testing string.

8. The valve of claim 7, wherein said sleeve valve section means further includes choke means for controlling the flow of fluid from said power section means to said valve sleeve.

9. The valve of claim 8, wherein said valve sleeve includes a cylindrical body having:

an annular valve mandrel receiving section having said neck of said valve mandrel slidably disposed therein;

an annular power section receiving section connected to said power section means and having said choke means disposed therein; and a cylindrical web section integrally connecting said valve mandrel receiving section with said power section receiving section, said web section having a longitudinal opening defined therein in communication with said choke means, and said web section further having defined therein a radial slot extending from said longitudinal opening to the exterior of said web section.

10. The valve of claim 9, wherein:

said sleeve valve section means further includes a hollow valve casing for receiving said valve mandrel and said valve sleeve, said valve casing having a first inner diameter; and said valve sleeve has an exterior surface with a second diameter less than said first diameter so that an annulus for receiving fluid flow is defined between said valve sleeve and said valve casing.

11. The valve of claim 10, wherein:

said valve casing has an inwardly directed lug; and said valve mandrel has an outwardly directed lug engaging said inwardly directed lug.

12. A valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through said valve in the testing string as well as the introduction of fluids into that portion of the wellbore below the packer through said valve in the testing string, said valve being responsive to changes in the pressure of the fluid in the annulus between the wellbore and the well testing string in that portion of the wellbore above the packer when the packer sealingly engages the wellbore, said valve comprising:

valve section means having a valve means therein in a closed position to prevent the flow of fluid through the well testing string, said valve means being responsive to changes in the pressure of the fluid in the annulus to open said valve means to allow the flow of fluid through the well testing string, said valve section means including:

adapter means for securing said valve to the testing string;

valve case means secured to said adapter means;

valve mandrel means, having one end secured to said adapter means and having another end which is longitudinally spaced from said one end disposed in the interior of said valve case means, for providing a closable flow path between the interior of said valve case means and the interior of said adapter means;

elongated valve sleeve means, having a first end, a second end and a central portion interconnecting said first and second ends, for receiving within said first end thereof said another end of said valve mandrel means, said first end having a transverse opening defined therein in longitudinal sliding relation to said flow path provided by said valve mandrel means; and choke means, disposed in said second end of said valve sleeve means, for controlling the flow of the fluids produced from or introduced into the wellbore;

power section means responsive to changes in the pressure of the fluid in the annulus, said power section means having first means therein adapted to move said valve means of said valve section means to the open position and adapted to return said valve means of said valve section means to the closed position from the open position in response to a change in the pressure of the fluid in the annulus, wherein said power section means comprises:

power case means releasably secured to said valve case means;

power mandrel means slidably disposed within said power case means and connected to said second end of said valve sleeve means so that said choke means is received in said power mandrel means;

fluid mandrel means secured within said power case means; and gas-fluid balancing seal means slidably disposed on said fluid mandrel means within said power case means; and isolation valve means, connected to said power section means, for being continuously responsive substantially without interruption during such time as said valve is located in said wellbore to changes in the pressure of the fluid in the annulus adapted to maintain said power section means at a level of force sufficient to close said valve means to said valve section means regardless of the hydrostatic pressure and temperature of the fluid in the annulus and the pressure and temperature of the fluid in said valve in the testing string.

13. The valve of claim 12, wherein:

said valve mandrel means includes a first unitary body having said one end integrally formed with said another end, said first unitary body having at said one end a first outer surface with a first diameter and having at said another end a second outer surface having a second diameter less than said first diameter, said first unitary body further having an inner surface defining a longitudinal first cavity extending between said ends, and said first unitary body still further having a plurality of circumferentially spaced flow ports defined in said another end between said inner surface and said second outer surface, said first cavity and said flow ports defining said flow path;

said valve sleeve means includes a second unitary body having said first and second ends and said central portion integrally formed therein, said second unitary body having an exterior surface with a third diameter greater than said second diameter, said second unitary body having at said first end a first interior surface with a fourth diameter approximately equal to said second diameter so that said second outer surface of said first unitary body is slidingly received adjacent said first interior surface, said second unitary body having a longitudinal second cavity defined within said central portion, and said second unitary body further having a plurality of circumferentially spaced flow slots defined in said central portion between said second cavity and said exterior surface of said second unitary body, said second unitary body also having a longitudinal third cavity defined in said second end by a second interior surface with a fifth diameter, said third cavity in fluid communication with said second cavity;

said power mandrel means has at least a portion thereof received in said third cavity and secured to said second unitary body, said power mandrel means having an inward surface with a sixth diameter less than said fifth diameter;

said choke means includes a third unitary body having a first outward surface with a seventh diameter approximately equal to said sixth diameter so that said third unitary body is received in said portion of said power mandrel means received in said third cavity, said third unitary body also having a second outward surface having an eighth diameter greater than said seventh diameter but less than said fifth diameter, said second outward surface disposed between said power mandrel means and said central portion of said valve sleeve means, and said third unitary body further having a longitudinal fourth cavity defined therethrough with a ninth diameter less than said seventh diameter, said fourth cavity in fluid communication with said second cavity.

14. The valve of claim 13, wherein said valve case means has a chamber defined therein for receiving said valve mandrel means, said valve sleeve means, and said choke means, said chamber having a tenth diameter greater than said third diameter so that an annulus is defined betwen said valve case means and said valve sleeve means for permitting longitudinal fluid flow between said flow slots and said transverse opening of said valve sleeve means.

15. The valve of claim 13, wherein:

said valve case means has an inwardly extending first lug; and said first outer surface has a second lug extending outwardly therefrom in engagement with said first lug.

16. The valve of claim 15, wherein said valve case means has a chamber defined therein for receiving said valve mandrel means, said valve sleeve means, and said choke means, said chamber having a tenth diameter greater than said third diameter so that an annulus is defined between said valve case means and said valve sleeve means for permitting longitudinal fluid flow between said flow slots and said transverse opening of said valve sleeve means.

17. The valve of claim 16, further comprising seal means, disposed on said another end of said valve mandrel means on opposite sides of said flow ports, for providing fluid-tight seals between said second outer surface and said first interior surface.

18. The valve of claim 13, further comprising seal means, disposed on said another end of said valve mandrel means on opposite sides of said flow ports, for providing fluid-tight seals between said second outer surface and said first interior surface.

* * * * *

UNITED STATES PATENT AND TRADEMARK OFFICE

CERTIFICATE OF CORRECTION

PATENT NO. : 4,573,535

DATED : March 4, 1986

INVENTOR(S) : Kevin R. Manke

It is certified that error appears in the above-identified patent and that said Letters Patent is hereby corrected as shown below:

In column 4, line 54, delete the word [Connection] and insert therefor --Connecting--.
In column 14, line 14, delete the word [betwen] and insert therefor --between--.

Signed and Sealed this

Second Day of December, 1986

*Attest:*

DONALD J. QUIGG

*Attesting Officer*

*Commissioner of Patents and Trademarks*